US005381608A

United States Patent [19]

Claveria

[11] Patent Number: 5,381,608

[45] Date of Patent: Jan. 17, 1995

[54] SHOE HEEL SPRING AND STABILIZER

[75] Inventor: R. Y. Claveria, Loma Linda, Calif.

[73] Assignee: L.A. Gear, Inc., Santa Monica, Calif.

[21] Appl. No.: 549,493

[22] Filed: Jul. 5, 1990

[51] Int. Cl.[6] ..... A43B 21/26

[52] U.S. Cl. ..... 36/35 R; 36/27; 36/7.8

[58] Field of Search ..... 36/7.8, 27, 34 R, 35 R, 36/37, 38; 267/158, 160, 163, 181; 280/605

[56] References Cited

U.S. PATENT DOCUMENTS

| | | | |
|---|---|---|---|
| 1,918,115 | 7/1933 | Luft | 267/163 X |
| 2,357,281 | 12/1943 | Williams | 36/38 |
| 2,394,281 | 2/1946 | Williams | 36/38 |
| 2,508,318 | 5/1950 | Wallach | 36/38 |
| 2,814,132 | 11/1957 | Montoscuro | 36/37 |
| 3,214,849 | 12/1963 | Nadaud | 36/38 |
| 3,238,780 | 3/1966 | Doyle | 267/160 X |
| 3,359,660 | 12/1967 | Nadaud | 36/37 |
| 3,389,902 | 6/1968 | Young | 267/163 X |
| 3,408,061 | 10/1968 | Meyer | 267/160 |
| 3,873,108 | 3/1975 | Lacarrau et al. | 280/605 |
| 3,902,260 | 9/1975 | Massella et al. | 36/35 R |
| 4,081,917 | 4/1978 | Bradley et al. | 36/76 R |
| 4,376,545 | 3/1983 | Sandorf | 267/158 X |
| 4,486,964 | 12/1984 | Rudy | 36/28 |
| 4,492,046 | 1/1985 | Kosova | 36/27 |
| 4,506,460 | 3/1985 | Rudy | 36/28 |
| 4,566,206 | 12/1986 | Weber | 36/7.8 |
| 4,598,487 | 7/1986 | Misevich | 36/114 |
| 4,638,575 | 1/1987 | Illustrato | 36/7.8 X |
| 4,709,489 | 12/1987 | Welter | 36/27 |
| 4,771,554 | 9/1988 | Hannemann | 36/27 |
| 4,815,221 | 3/1989 | Diaz | 36/27 |
| 4,843,737 | 7/1989 | Vorderer | 36/38 |
| 4,854,057 | 8/1989 | Misevich et al. | 36/114 |
| 4,874,640 | 10/1989 | Donzis | 36/37 X |
| 4,878,300 | 11/1989 | Bogaty | 36/35 R |
| 4,881,329 | 11/1989 | Crowley | 36/38 |
| 4,942,677 | 7/1990 | Flemming et al. | 36/27 |
| 5,046,267 | 9/1991 | Kilgore et al. | 36/114 |

FOREIGN PATENT DOCUMENTS

| | | | |
|---|---|---|---|
| 294073 | 9/1916 | Germany | 267/163 |
| 633409 | 2/1962 | Italy . | |
| 426551 | 6/1967 | Switzerland | 36/37 |
| 1081988 | 9/1967 | United Kingdom | 36/37 |

OTHER PUBLICATIONS

Undated Etonic Brochure/Catalog RE "Etonic Stability System".

*Primary Examiner*—BethAnne C. Cicconi

*Attorney, Agent, or Firm*—Don C. Lawrence

[57] ABSTRACT

A thin, heel-sized plate formed of a composite sandwich of thermoplastic resin and carbon-glass fiber cloth has a pair of upwardly-flanged lateral edges, front and rear ends, and an integral, rearwardly-extending, upwardly-inclined, vertically-acting spring member appending from it. The device is encapsulated within the resilient material of the heel portion of the midsole of an athletic shoe such that the spring member is disposed below the calcaneus of the wearer's foot. The midsole is relieved in an area below the spring member to permit it to bend downward freely in response to heel-imparted forces. A "snubber" or stopper bushing can be molded into the outsole of the shoe to limit the maximum deflection of the spring member.

17 Claims, 2 Drawing Sheets

14B
1
4
22B
6
12
20
16
22A
3
3
28
5
10
18
6
14A
4

2
1
20
14B
12
16
3
18
10
6
5
2
2

Fig. 3.
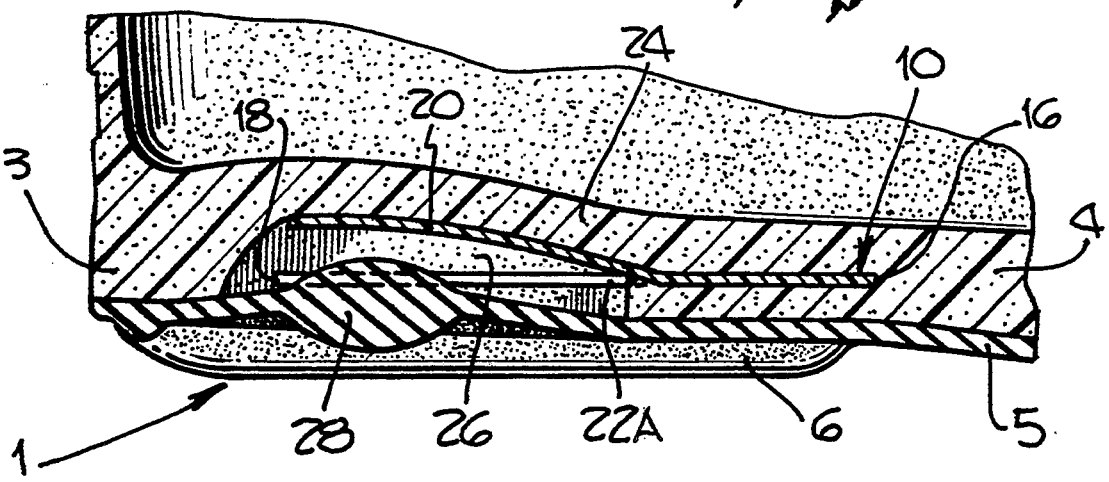
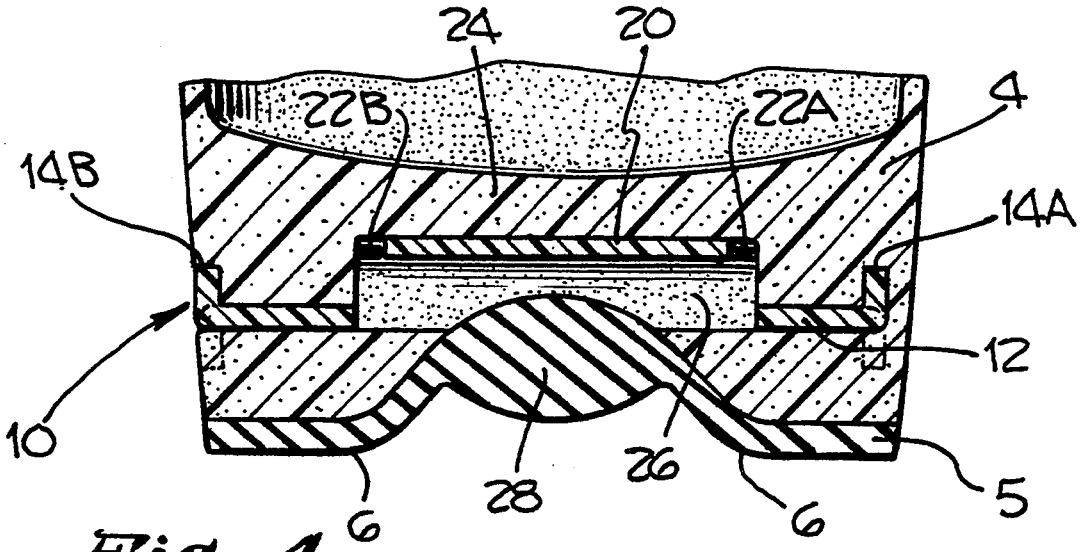
Fig. 4.
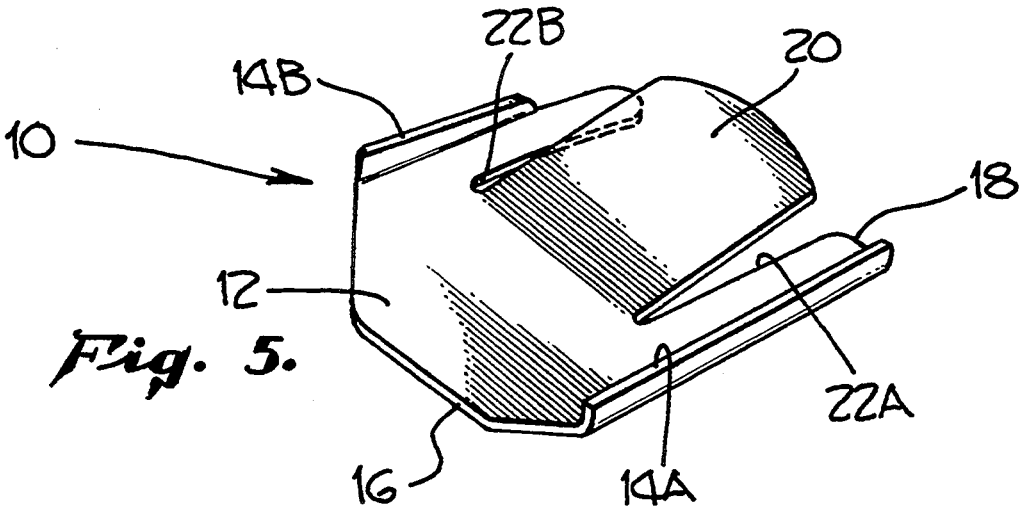
Fig. 5.

SHOE HEEL SPRING AND STABILIZER

BACKGROUND

1. Field of the Invention

This invention pertains to footwear in general, and in particular, to a heel spring and foot stabilizing device for an athletic shoe.

2. Description of the Related Art

For most, the act of walking or running involves the use of the entire foot, and starts with heel strike, followed by a rolling onto the mid-foot, and then finally by a propelling off of the forefoot and toes. Before heel strike, the foot is in a supinated position, i.e., oriented at an upward angle relative to the ground and twisted outwardly. At heel strike, the involved ankle, knee and hip all flex to cushion and absorb the shock of the impact, and the foot rolls and turns inward in a process called pronation.

During this sequence, it is desirable to absorb as much of the foot strike shock energy as possible, consistent with landing stability, to avoid chronic or traumatic injury to the runner. Where possible, and again, consistent with good running stability, it is also desirable to store the shock energy absorbed and return it to the foot during the propelling-off portion of the stride, for energy-efficiency reasons. It is also desirable to limit any tendency of the foot to over-supinate or to over-pronate during contact of the foot with the ground for both medical and running stability reasons.

It is known in the shoe art to incorporate spring devices in the soles of shoes, and particularly the heels of the shoes, to store shock energy imparted by foot strike during running and to return at least a portion of that energy to the wearer's foot during foot lift. It is likewise known to provide transverse and longitudinal stiffening elements within the sole of a shoe to overcome the effect of over-supination or over-pronation of the wearer's foot during running.

For example, in U.S. Pat. Nos. 4,486,964 and 4,506,460, M. F. Rudy describes various types of plastic and heat-treated steel "spring moderators" whose primary purpose is said to be to distribute foot strike forces more evenly and quickly to underlying, gas-filled sole members. A horseshoe-shaped heel component of these moderators is said to act like a Bellville spring in cooperation with the foot to store and return energy during running, and in one version, is also said to provide vertical stabilization of the ankle.

In U.S. Pat. Nos. 2,357,281 and 2,394,281, V. P. Williams discloses a shock resisting built-up heel assembly for dress shoes which incorporates a steel spring.

In U.S. Pat. No. 4,709,489, K. F. Welter describes a spring device for a shoe heel which comprises a steel plate supported at its lateral ends by a U-shaped, non-compressible support member. In addition to providing a heel-spring effect, the support member is also said to provide lateral stabilization of the heel.

In U.S. Pat. No. 4,881,329, K. J. Crowley discloses yet another form of energy storing heel spring which is said to be moldable from high tensile materials such as graphite and/or glass fibers and resin.

Finally, the Etonic company of Brockton, Mass., advertises a "Stability System" which includes various configurations of a "DRP Plus Plate" made of a composite of graphite, acrylic and fiberglass, and which is disposed in various locations within the soles of its shoes to compensate for over-pronation and/or over-supination problems of individual wearers.

This application discloses a novel device for encapsulation within the midsole of an athletic shoe which combines the advantages of a heel spring for absorbing, storing and returning to the wearer's foot the shock energy experienced during running, and a stabilizer plate which, during the same activity, aids in the prevention of over-supination and over-pronation of the foot. Because of the methods and material of its manufacture, the device is simple and inexpensive to manufacture and very light in weight.

SUMMARY OF THE INVENTION

The device comprises a thin, heel-sized plate formed of a strong, stiff, yet resiliently-flexible composite sandwich of thermoplastic resin and carbon-glass fiber cloth which is encapsulated within the heel portion of the midsole of an athletic shoe. The plate has a pair of upwardly-flanged lateral edges, front and rear ends, and an integral, rearwardly-extending, upwardly-inclined, vertically-acting spring member appending from it. The spring is defined on the plate by a pair of open slots extending forwardly into the plate from its rear end. The spring member is disposed to reside beneath the calcaneus of the wearer's foot, and the midsole of the shoe is relieved in an area below the spring member to permit it to bend downward freely in response to heel-imparted forces. A "snubber" or stopper bushing can be molded into the outsole of the shoe to limit the maximum downward deflection of the spring member.

A better understanding of the device, along with its many attendant advantages, can be had from a consideration of the detailed description of its preferred embodiments which follows hereinafter, particularly when considered in light of the accompanying drawings, of which the following is a brief description.

BRIEF DESCRIPTION OF THE DRAWINGS

FIG. 3 is a partial cross-sectional side view through the shoe heel and the device of the present invention shown in FIGS. 1 and 2, as revealed by the section 3—3 taken in FIG. 2;

FIG. 4 is a partial cross-sectional view looking rearward into the shoe heel and device seen in FIGS. 1–3, as revealed by the section 4—4 taken in FIG. 2; and FIG. 5 is a perspective view of the heel spring and stabilizer plate device of the present invention.

DETAILED DESCRIPTION OF THE PREFERRED EMBODIMENTS

Figure 2:
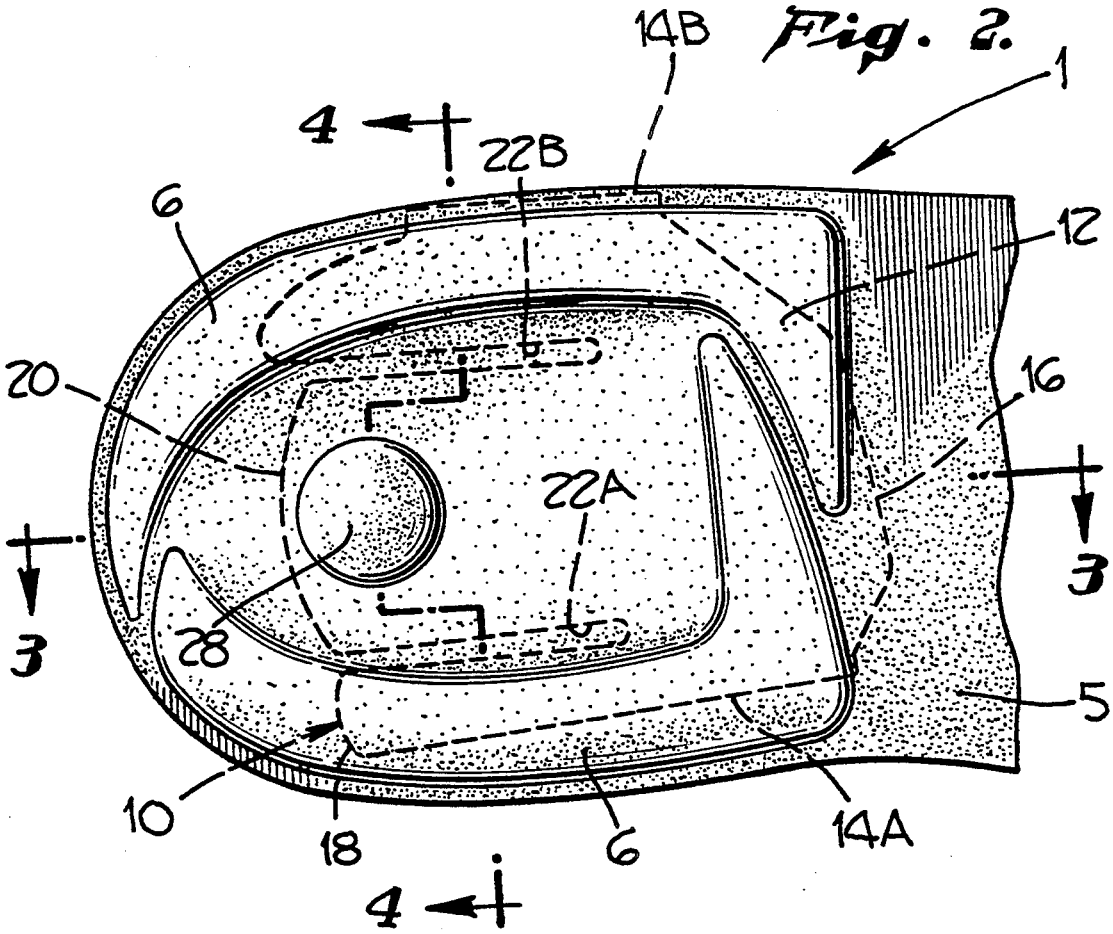
FIG. 2 is a partial bottom view of the heel of the same shoe seen in FIG. 1, as revealed by the view taken along the line 2—2 therein, in which the device of the present invention is also shown in dotted lines.
Figure 1:
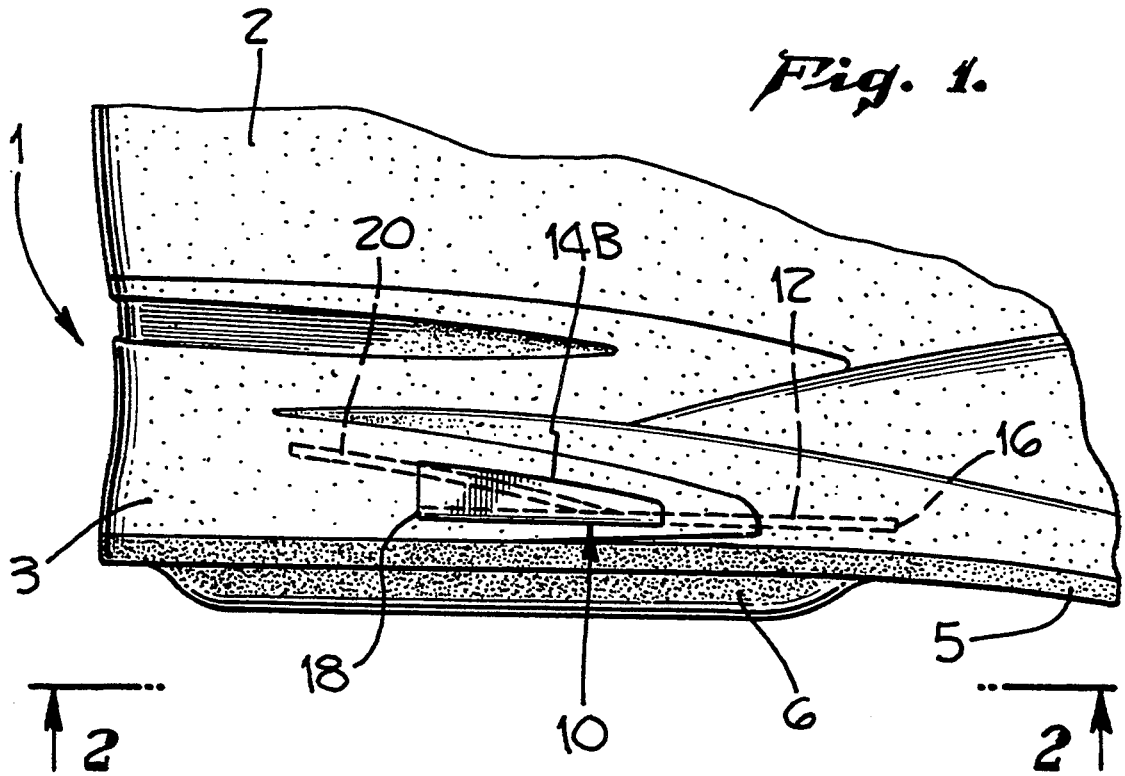
FIG. 1 is a partial side view of the heel of a right-foot athletic shoe within which the device of the present invention is shown in dotted lines.

As best seen in FIGS. 1 and 2, an athletic shoe 1 typically comprises an upper 2, and a lower, or sole portion 3. The shoe 1 may be characterized as a "court" shoe, a "running" shoe, or a "cross-trainer" shoe, depending upon its particular purpose and styling.

The upper 2 may incorporate either a high top or a low top configuration, and may be fabricated from leather and/or a variety of man-made materials, including vinyl. The sole portion 3 typically comprises a midsole 4 and an outsole 5. The sole portion 3 may also incorporate an insole layer (not illustrated) which is integral to, or separate from, the midsole and which is contoured to conform closely to the underside of the wearer's foot and distribute foot loads to the midsole more uniformly.

Typical midsole materials for modern athletic shoes include foamed ethylene vinyl acetate ("EVA") and foamed polyurethane ("PU"), which can be molded to include many desirable functional and ornamental details and dimensional features, as well as to encapsulate devices, such as the device of the present invention, within the thickness of the midsole during the molding process.

Typical materials for the outsole 5 include many man-made rubbers and unfoamed PU. As in the case of the materials of the midsole 4, these also lend themselves well to the incorporation by molding of desirable features or patterns on the underside or outer walls of the outsole 5, such as the lands 6 seen in the figures. An example of one possible outsole pattern is illustrated in this applicant's co-pending U.S. Design Patent application for an outsole, Ser. No. 07/505,003, filed Apr. 5, 1990.

An exemplary preferred embodiment of a heel spring and stabilizer device 10 for an athletic shoe that comprises the subject of this invention is better visualized in FIGS. 3–5 of the drawings. The device 10 illustrated is for a right-foot shoe 1, and is to be understood as comprising one of a pair of such devices, one in each of a pair of such shoes, the other, left one of which is symmetrical to the device 10 illustrated about a sagittal plane through the wearer.

The device 10 comprises a thin, flat, heel-sized plate 12 which is formed of a strong, stiff, yet resiliently-flexible material described below. The device is encapsulated in a generally horizontal position within the resilient material of the heel portion of the midsole 4 during the molding of the latter, as described above.

The plate 12 is preferably die cut from a larger sheet stock of flat material, then formed up as described below. It has a pair of upwardly-flanged lateral edges 14A and 14B, front and rear ends 16 and 18, respectively, and an integral, rearwardly-extending, upwardly-inclined, vertically-acting spring member 20 defined on it by a pair of open slots 22A and 22B which extend forwardly into the plate from its rear end 18.

The device 10 illustrated may be fabricated from a variety of materials, including heat-treated spring steel, but the preferred material for the exemplary device 10 is a composite sandwich of a thermoplastic resin having face sheets consisting of woven fibers, or a matrix, of carbon and fiberglass. The material, which is sold by the Medical Materials Corporation for biomedical applications under the trademark TL-61®, and for commercial applications under the name Novetek™, is described in more detail in U.S. Pat. No. 4,778,717.

The preferred material is available in sheets having thicknesses ranging between 0.035 and 0.055 inches. It has a tensile strength, depending upon thickness, of between 24 and 42 thousand pounds per square inch ("psi"), and a modulus of elasticity of between 1.3 and 3.6 million psi. It is easily cut, sawn, or, as in the case of the preferred embodiment illustrated, die cut using relatively inexpensive tooling.

The material may be further thermo-formed to include various desirable shapes or contours, such as the upward inclination of the spring member 20 and the upwardly-flanged lateral edges 14A, 14B, by heating the material at relatively low temperatures (350°–500° F.) in appropriate tooling. When the temperature of the material thus formed is returned to room temperature, its elasticity and strength are entirely restored. Life cycle tests have been conducted by this applicant on test samples of a configuration of the device 10 substantially similar to the exemplary embodiment illustrated in which the spring member 20 was deflected from its undeflected condition to a position flush with the plate 12 at a rate of six cycles per second. The test specimens sustained more than 1 million such cycles without failure and without showing any fractures, fatigue cracks or measurable loss in material strength or elasticity. Thus, it may be seen that the physical properties of the preferred composite material compare very favorably with that of heat-treated steel alloys, yet are achieved at a significant reduction in weight and manufacturing cost, when compared to equivalent steel parts.

The device 10 is disposed within the heel area of the material of the midsole 4 such that the rearmost portion of the spring member 20 resides generally below the large heel bone, or calcaneus, of the wearer's foot, and such that a layer 24 of the material of the midsole 4 overlays it. The midsole is relieved in an area 26 below the spring member to permit the latter to deflect downward freely.

The layer 24 acts as a cushion between the pad of tissue below the wearer's heel bone and the upper surface of the spring member 20 and also serves to distribute more evenly the load imparted to the spring member by the foot. The layer 24 also acts to reduce somewhat the total elasticity of the spring member as seen by the heel, as well as the ability of the spring member to return its energy of deflection during heel-raise, due mostly to energy lost by heat dissipation in the layer 24 during compression and expansion. However, this slight loss is thought to be acceptable in terms of enhanced foot comfort and to prevent a heel-spring action that is too "springy." Except for this effect and the deflection-limited condition described below, the response of the spring member is fairly linear over its entire intended range of deflection and is highly efficient (>85%) in returning to the wearer's foot at heel-lift the deflection energy stored within it at heel strike.

In the preferred embodiment, the lateral edges 14A, 14B of the late 12 are shown flanged upwardly, but could also be flanged downwardly in an appropriate design, as shown by the dotted-line flanges 14A' and 14B' seen in FIG. 4. The flanged edges serve to stiffen the device considerably in the longitudinal direction and, because they are disposed slightly outboard of the heel of the wearer's foot on either side, act like outriggers on a canoe to prevent over-supination and over-pronation of the wearer's foot during the sequence of heel strike, foot roll, and push-off experienced during normal walking or running. The flanged edges also help to anchor and prevent creep of the device 10 within the material of the midsole 4, should the device become unadhered from the midsole material for any reason.

In the exemplary preferred embodiment illustrated, an optional "snubber" or stopper 28 is molded into the outsole 5 of the shoe and positioned immediately below the spring member 20 and calcaneus bone to limit the maximum downward deflection of the spring member during large heel-imparted shocks, such as would occur during jumping. The vertical dimension of the snubber 28 is dimensioned so that it does not contact the spring member 20 during normal standing or walking activity, but comes into effect only at spring member deflections which exceed a desirable maximum downward deflection of the spring member, such as would occur during jumping or hard running activities.

The skilled practitioner will recognize from the foregoing discussion that many modifications are possible to the features, materials and methods of manufacture of the heel spring and stabilizer plate device disclosed herein, depending upon the particular problem or application at hand. Accordingly, the embodiments illustrated and discussed herein should be taken as exemplary in nature only, and the scope of the present invention should be limited only by the claims which follow.

What is claimed is:

1. In an athletic shoe of the type which includes an upper portion and a sole portion, the sole portion including a heel part and a resilient midsole and outsole, an improved mechanism for absorbing foot shock, storing and returning running energy to the foot of the wearer, and stabilizing the wearer's foot during running, the improvement comprising:

a thin, substantially planar, heel-sized plate formed of a strong, stiff, yet resiliently-flexible material fixed by its encapsulation within the midsole of the heel part of the sole in a generally horizontal position above the outsole, the plate having a pair of lateral edges, front and rear ends, and at least one slot cut through it such that a generally planar, rearwardly-extending spring member that is resiliently deflectable and independently moveable with respect to the plate is defined therein, the spring member being permanently formed relative to the plane of the plate to incline upwardly and rearwardly from it and having a rear portion positioned below the calcaneus of the wearer's foot, and the midsole being relieved in an area below the spring member to permit it to bend freely downward.

2. The mechanism of claim 1, wherein the spring member is defined by a pair of open slots extending forwardly into the plate from its rear end.

3. The mechanism of claim 1, wherein the material of the plate comprises a composite of a carbon-and-glass fiber matrix and a thermoplastic resin.

4. The mechanism of claim 1, wherein the lateral edges of the plate are flanged upwardly.

5. The mechanism of claim 1, wherein the lateral edges of the plate are flanged downwardly.

6. The mechanism of claim 1, wherein the outsole of the shoe includes a stopper of resilient material disposed below the spring member to limit the maximum downward deflection of the spring.

7. An athletic shoe having shock absorbing, energy storing, and foot stabilizing properties, comprising:

an upper;

a sole attached to the upper, the sole having an insole, an outsole, and a resilient midsole having a heel portion;

a thin, substantially planar, heel-sized plate formed of a strong, stiff, yet resiliently-flexible material encapsulated within the material of the heel portion of the midsole such that the plate is fixed within the midsole in a generally horizontal position above the outsole, and a thickness of the midsole overlays it, the plate having a pair of lateral edges, front and rear ends, and a generally planar, rearwardly-extending spring member that is resiliently deflectable and independently moveable with respect to the plate defined therein by at least one slot extending through it, the spring member being permanently formed at an angle relative to the plate to incline upwardly and rearwardly from it and having a rear portion disposed to reside generally below the calcaneus of the wearer's foot and be deflected downwardly thereby during heel strike of the foot, the midsole being relieved in an area below the spring member and above the outsole such that the spring member may bend freely in the vertical direction when deflected downwardly; and a stopper of resilient material disposed on the outsole below the spring member to limit its maximum downward deflection.

8. The shoe of claim 7, wherein the spring member is defined by a pair of open slots extending from the rear end of the plate forwardly.

9. The shoe of claim 7, wherein the material of the plate comprises a composite of a thermoplastic resin and a carbon-and-fiber-glass fabric.

10. The shoe of claim 7, wherein the lateral edges of the plate are flanged upwardly.

11. The shoe of claim 7, wherein the lateral edges of the plate are flanged downwardly.

12. An athletic shoe having shock absorbing, energy storing, and rear foot stabilizing properties, comprising:

an upper;

a sole attached to said upper, said sole having at least a resilient midsole and an elastomeric outsole, said midsole and said outsole each having a heel portion generally disposed below the wearer's heel;

a generally planar, longitudinally extending, vertically acting spring member made of a strong, stiff, yet resiliently-flexible material disposed in said heel portion of said midsole such that a layer of said midsole overlays it, said spring member having a front end fixed against movement therein, and a rear portion inclining upwardly and rearwardly from said front end in cantilever fashion such that said rear portion resides generally below the calcaneous of the wearer's heel and is resiliently deflectable thereby during heel strike of the foot, said midsole being relieved in an area below said spring member to permit it to bend freely in the vertical direction; and means for fixing said front end of said spring member in said midsole and for laterally stabilizing the wearer's heel during heel strike of the foot.

13. The athletic shoe of claim 12, wherein said means for fixing said front end of said spring member and for laterally stabilizing said wearer's heel further comprise:

a thin, substantially planar, heel-sized plate formed of a strong, stiff, yet resiliently-flexible material encapsulated within said heel portion of said midsole such that said plate is fixed therein in a generally horizontal position above said outsole, said plate having front and rear ends and a pair of lateral edges extending to about the lateral margins of the wearer's heel, and said front end of said spring member being fixed to said plate such that said spring member inclines at an angle upwardly and rearwardly therefrom and is resiliently deflectable and independently moveable relative thereto.

14. The athletic shoe of claim 13, wherein said spring member and said plate are formed of a single piece, said spring member being defined in said plate by at least one slot cut through it and permanently formed relative to the plane of the plate to incline upwardly and rearwardly from it.

15. The athletic shoe of claim 14, wherein said spring member is defined by a pair of slots that open to the rear end of the plate and extend forwardly into it.

16. The athletic shoe of claim 13, wherein said lateral edges of said plate are flanged in a direction generally normal to the plane of said plate for stiffness and for anchoring of said plate in said midsole.

17. The athletic shoe of claim 12, further comprising a stopper of resilient material disposed on said outsole below said rear portion of said spring member to limit its downward deflection.

* * * * *